US009925503B2

(12) United States Patent
Enomura

(10) Patent No.: US 9,925,503 B2
(45) Date of Patent: Mar. 27, 2018

(54) STIRRING-PROCESSING APPARATUS AND PROCESSING METHOD

(71) Applicant: M. TECHNIQUE CO., LTD., Izumi-shi, Osaka (JP)

(72) Inventor: Masakazu Enomura, Izumi (JP)

(73) Assignee: M. TECHNIQUE CO., LTD., Izumi-Shi, Osaka (JP)

( * ) Notice: Subject to any disclaimer, the term of this patent is extended or adjusted under 35 U.S.C. 154(b) by 259 days.

(21) Appl. No.: 14/655,291

(22) PCT Filed: Dec. 25, 2012

(86) PCT No.: PCT/JP2012/083502

§ 371 (c)(1),
(2) Date: Jun. 24, 2015

(87) PCT Pub. No.: WO2014/102906

PCT Pub. Date: Jul. 3, 2014

(65) Prior Publication Data

US 2015/0328602 A1 Nov. 19, 2015

(51) Int. Cl.
*B01F 5/06* (2006.01)
*B01F 3/08* (2006.01)
(Continued)

(52) U.S. Cl.
CPC ..... *B01F 5/0661* (2013.01); *B01F 3/0807* (2013.01); *B01F 7/0085* (2013.01); *B01F 7/166* (2013.01); *B01F 7/1635* (2013.01)

(58) Field of Classification Search
CPC .... B01F 3/0807; B01F 5/0661; B01F 7/0085; B01F 7/1635; B01F 7/166
(Continued)

(56) References Cited

U.S. PATENT DOCUMENTS 2,875,897 A * 3/1959 Booth ..... B03D 1/16 209/169
3,393,802 A * 7/1968 Daman, Jr. ..... B03D 1/16 209/169
(Continued)

FOREIGN PATENT DOCUMENTS

CN 1256643 A 6/2000
DE 2702183 A1 7/1978
(Continued)

OTHER PUBLICATIONS

EPO Machine Translation, JP H 04-114725 (A), family of JP-2813674 (B2), side by side translation, retrived on Apr. 2017, 14 pages.*

*Primary Examiner* — Tony G Soohoo
(74) *Attorney, Agent, or Firm* — Birch, Stewart, Kolasch & Birch, LLP

(57) ABSTRACT

A stirring-processing apparatus and a processing method are provided to realize excellent processing of a fluid regardless of the properties of the fluid. The stirring-processing apparatus is provided with the stirring blade and the stirring chamber provided with the screen, wherein the apparatus performs, under a state in which the stirring chamber is disposed in a fluid to be processed, a process of applying a shear force to the fluid by a relative rotation between the screen and the stirring blade. The stirring chamber is provided with the suction opening to suck the fluid from outside to inside and the ejecting opening to eject the fluid from inside to outside; these openings being disposed above and below. The suppressing body to control a flow of the fluid is disposed between the suction opening and the ejecting opening. The suppressing body is, for example, in the form
(Continued)

of a cylinder, and is interposed between the suction flow and the ejecting flow, thereby suppressing interference between the two flows.

15 Claims, 6 Drawing Sheets

(51) Int. Cl.
*B01F 7/00* (2006.01)
*B01F 7/16* (2006.01)

(58) Field of Classification Search
USPC ..... 366/296
See application file for complete search history.

(56) References Cited

U.S. PATENT DOCUMENTS 4,333,834 A * 6/1982 Werner ..... B01F 3/04617 210/219
4,570,863 A * 2/1986 Knox, Jr. ..... B02C 9/00 241/33
4,637,555 A * 1/1987 Furuichi ..... B01F 7/00758 241/101.2
4,738,543 A * 4/1988 Seeger ..... B01F 15/00012 366/264
4,813,617 A * 3/1989 Knox, Jr. ..... B02C 23/36 241/33
5,522,553 A * 6/1996 Leclair ..... B02C 18/062 241/185.6
6,024,483 A 2/2000 Burke et al.
6,319,996 B1 11/2001 Burke et al.
6,402,065 B1 * 6/2002 Higgins ..... B02C 18/0092 241/185.6
6,412,714 B1 * 7/2002 Witsken ..... B01F 7/0075 241/21
8,192,911 B2 * 6/2012 Awamura ..... G03G 9/0804 430/137.1
2004/0130043 A1 7/2004 Boulant
2004/0251337 A1 * 12/2004 Araki ..... B01F 3/1221 241/27
2007/0128537 A1 * 6/2007 Ariyoshi ..... G03G 9/0804 430/137.1
2011/0026358 A1 2/2011 Cheio De Oliveira et al.

FOREIGN PATENT DOCUMENTS

DE 3045795 A1 6/1982
EP 0201927 A2 11/1986
JP 4-114724 A 4/1992
JP 4-114725 A 4/1992
JP 2813674 B2 * 10/1998 ..... B01F 7/16
JP 2002-91071 A 3/2002
JP 2004-528973 A 9/2004
JP 2006-221023 A 8/2006
JP 2011-123236 A 6/2011

* cited by examiner (A)
(B)

13
14
24
23
25
18
19
20
34
33
31
32

STIRRING-PROCESSING APPARATUS AND PROCESSING METHOD

TECHNICAL FIELD

The present invention relates to a stirring-processing apparatus and to a processing method, especially to a processing apparatus and to a processing method wherein a stirring chamber is immersed in a fluid thereby applying a shear force to the said fluid.

BACKGROUND ART

Inventor of the present invention developed the stirring-processing apparatus shown in Patent Documents 1 and 2, wherein a stirring chamber is immersed in a fluid thereby applying a shear force to the said fluid. In addition, as shown in Patent Document 3, various methods to produce a toner by using this apparatus have been proposed.

This stirring-processing apparatus is provided with a stirring chamber which is disposed in a fluid to be processed and with a rotating blade which is disposed in the said stirring chamber, wherein the stirring chamber is provided with a suction opening through which the fluid is sucked from outside into inside thereof by rotation of the rotating blade and with an ejecting opening through which the fluid is ejected from inside to outside thereof by rotation of the rotating blade, the both openings being disposed side by side in the direction of the axis of the rotating blade. In this apparatus, the rotating blade rotates at a high speed inside the stirring chamber, thereby carrying out the process of applying a shear force to the fluid. Especially, a screen rotates at a high speed in the opposite direction of the rotation direction of the rotating blade thereby applying the shear force to the fluid in a space formed with the rotating blade; and therefore, the fluid can be processed by such processes as emulsification, dispersion, and mixing.

However, there were some cases that the throughput expected by a designer could not be obtained. Inventor of the present invention investigated the reason for this, and then it was found that there are some cases that the suction flow of the fluid flowing into the suction opening from outside and the ejecting flow of the fluid ejected from the ejecting opening to outside interfere with each other, as a result, disturbing the flow of the suction flow into the suction opening, so that sufficient amount of the fluid cannot be introduced into the stirring chamber. Especially, this tendency appears eminently in a highly viscous fluid; and in such a case, there was even a case that a cavitation was formed around the suction opening.

In addition, in Patent Document 3, it is proposed that the difference between the angle formed between the introduction direction of the fluid into the stirring chamber and the rotation axis of the rotating blade and the angle between the discharge direction from the stirring chamber and the rotation axis of the rotating blade is made within the range of ±25 degrees. When the both angles are changed as mentioned above, there may be a case that the suction flow and the ejecting flow interfere with each other regardless of the viscosity.

PRIOR ART DOCUMENTS

Patent Documents

Patent Document 1: Japanese Patent Laid-Open Publication No. H04-114724

Patent Document 2: Japanese Patent Laid-Open Publication No. H04-114725

Patent Document 3: Japanese Patent Laid-Open Publication No. 2011-123236

DISCLOSURE OF INVENTION

Problems to be Solved by the Invention

In view of the situation as mentioned above, the problems to be solved by the present invention are to provide a stirring-processing apparatus and a processing method to realize excellent processing of a fluid regardless of the properties of the fluid.

Means for Solving the Problems

The present invention provides a stirring-processing apparatus, which is provided with a stirring blade rotating at a high speed and a stirring chamber provided with a screen which is disposed such that the stirring blade may be enclosed therein and which performs, under a state in which the stirring chamber is disposed in a fluid to be processed, a process of applying a shear force to the fluid by rotating at least any one of the screen and the stirring blade thereby effecting a relative rotation between the screen and the stirring blade, wherein the stirring chamber is provided with a suction opening to suck the fluid from outside to inside and an ejecting opening to eject the fluid from inside to outside by the relative rotation, these openings being disposed in different positions in a direction of a rotation axis of the relative rotation; and a suppressing body to control a flow of the fluid is disposed between the suction opening and the ejecting opening, the suppressing body being interposed between a suction flow which is a flow of the fluid from outside into the suction opening and an ejecting flow which is a flow of the fluid ejected from the ejecting opening to outside, thereby suppressing an interference between the suction flow and the ejecting flow.

In addition, the present invention may be executed as an embodiment wherein the suppressing body has its front end side projected toward outside the stirring chamber.

In addition, the present invention may be executed as an embodiment wherein the suppressing body is getting apart from the ejecting opening in a direction of a rotation axis of the relative rotation as moving up along the said body from a base end side to the front end side.

In addition, the present invention may be executed as an embodiment wherein the suppressing body is continuous in a circumferential direction.

In addition, the present invention may be executed as an embodiment wherein the suppressing body is a cylindrical form in which beyond the suction opening, the front end side thereof is getting apart from the ejecting opening in a direction of the rotation axis of the relative rotation.

In addition, the present invention may be executed as an embodiment wherein an introducing fin to introduce the fluid by rotation thereof is arranged, and an edge of the front end side of the suppressing body is located in a position more apart from the suction opening than an edge of the introducing fin located in the nearest position to the suction opening in a direction of the rotation axis of the relative rotation.

In addition, the present invention provides a stirring-processing method, in which a fluid is stirred by using a stirring apparatus provided with a stirring chamber and a stirring blade disposed in the stirring chamber; the stirring chamber being provided with a suction opening and an ejecting opening disposed side by side in an axial direction of the stirring blade and also being provided with a screen having plural slits, wherein the stirring chamber is disposed in the fluid; and the method comprises a step of fluid transportation by rotating at least any one of the screen and the stirring blade to effect a relative rotation between the screen and the stirring blade whereby sucking the fluid from outside the stirring chamber into inside thereof while ejecting the fluid from the ejecting opening to outside and a step for carrying out a process of applying a shear force to the fluid in between the stirring blade and the screen by the relative rotation during the step of fluid transportation; and a suppressing body to control a flow of the fluid is disposed between a suction flow which is a flow of the fluid from outside into the suction opening and an ejecting flow which is a flow of the fluid ejected from the ejecting opening to outside, thereby suppressing an interference between the suction flow and the ejecting flow.

In addition, the present invention may be executed as an embodiment wherein the stirring apparatus is provided with an introducing fin to introduce the fluid by rotation thereof; and an introducing flow of the fluid generated by rotation of the introducing fin is guided to the suction opening by the suppressing body.

In addition, the present invention may be executed as an embodiment wherein the fluid contains a raw material composition of a toner.

Advantages

According to the present invention, provided are the stirring-processing apparatus and the processing method to realize excellent processing of a fluid regardless of the properties of the fluid.

This is the explanatory structure drawing of the stirring-processing apparatus according to one embodiment of the present invention.

FIG. 2

(A): This shows the enlarged cross section view of the essential part of the same stirring-processing apparatus. (B): This is the explanatory drawing of driving of the same in the B-B cross section line.

FIG. 3

(A): This is the explanatory breakdown drawing of the same stirring-processing apparatus. (B): This is the explanatory breakdown drawing in the cross section of the same.

FIG. 4

(A): This is the explanatory structure drawing of the stirring-processing apparatus according to other embodiment of the present invention. (B): This is the top view showing the modification example of the suppressing body of the same stirring-processing apparatus. (C): This is the top view showing the still other modification example of the suppressing body of the same stirring-processing apparatus.

FIG. 5

This is the explanatory structure drawing of the stirring-processing apparatus according to still other embodiment of the present invention.

FIG. 6

This is the explanatory structure drawing of the stirring-processing apparatus according to still other embodiment of the present invention.

BEST MODES FOR CARRYING OUT THE INVENTION

Hereunder, embodiments of the present invention will be explained on the basis of the drawings.

Figure 1:
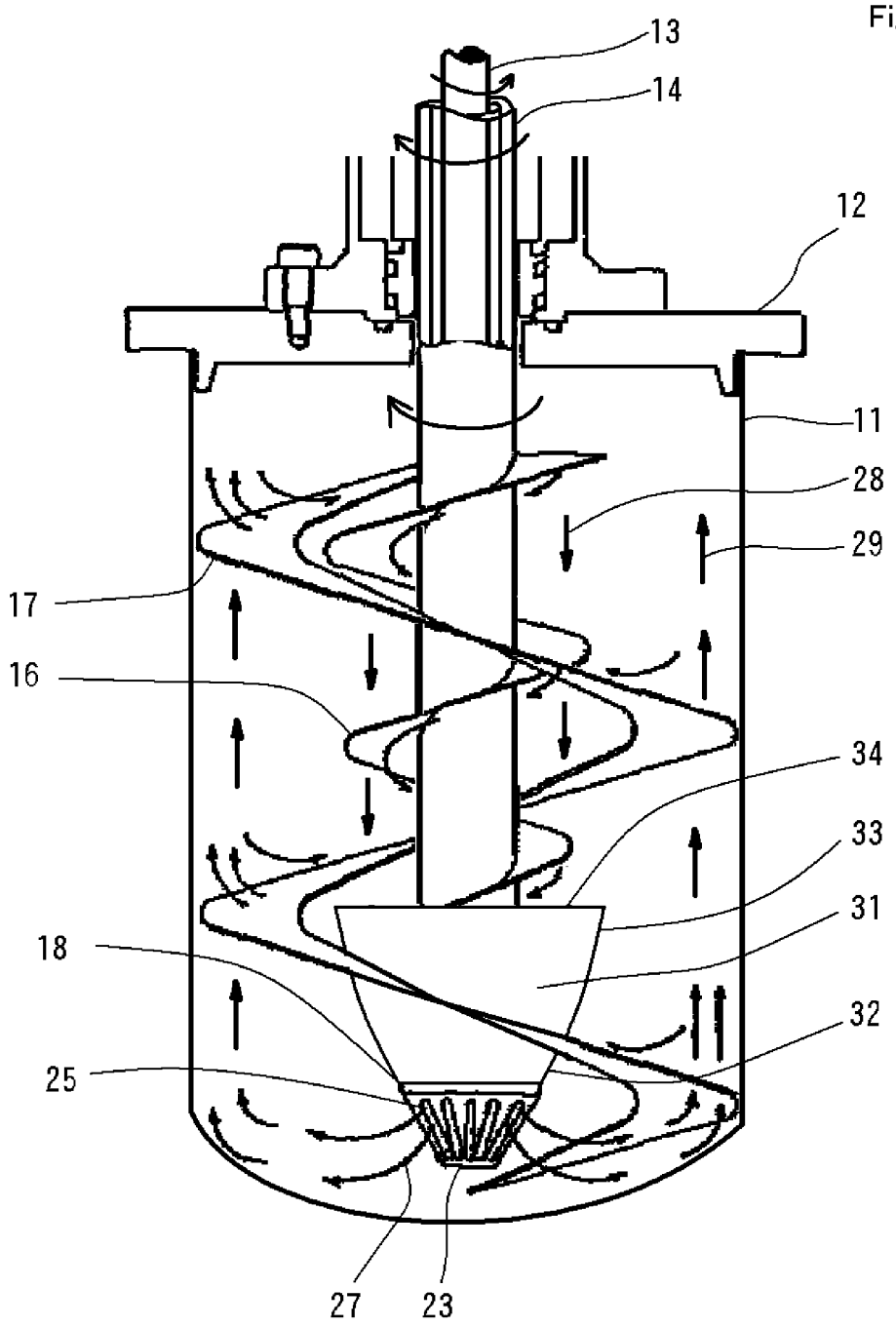
FIG. 1
Figure 2:
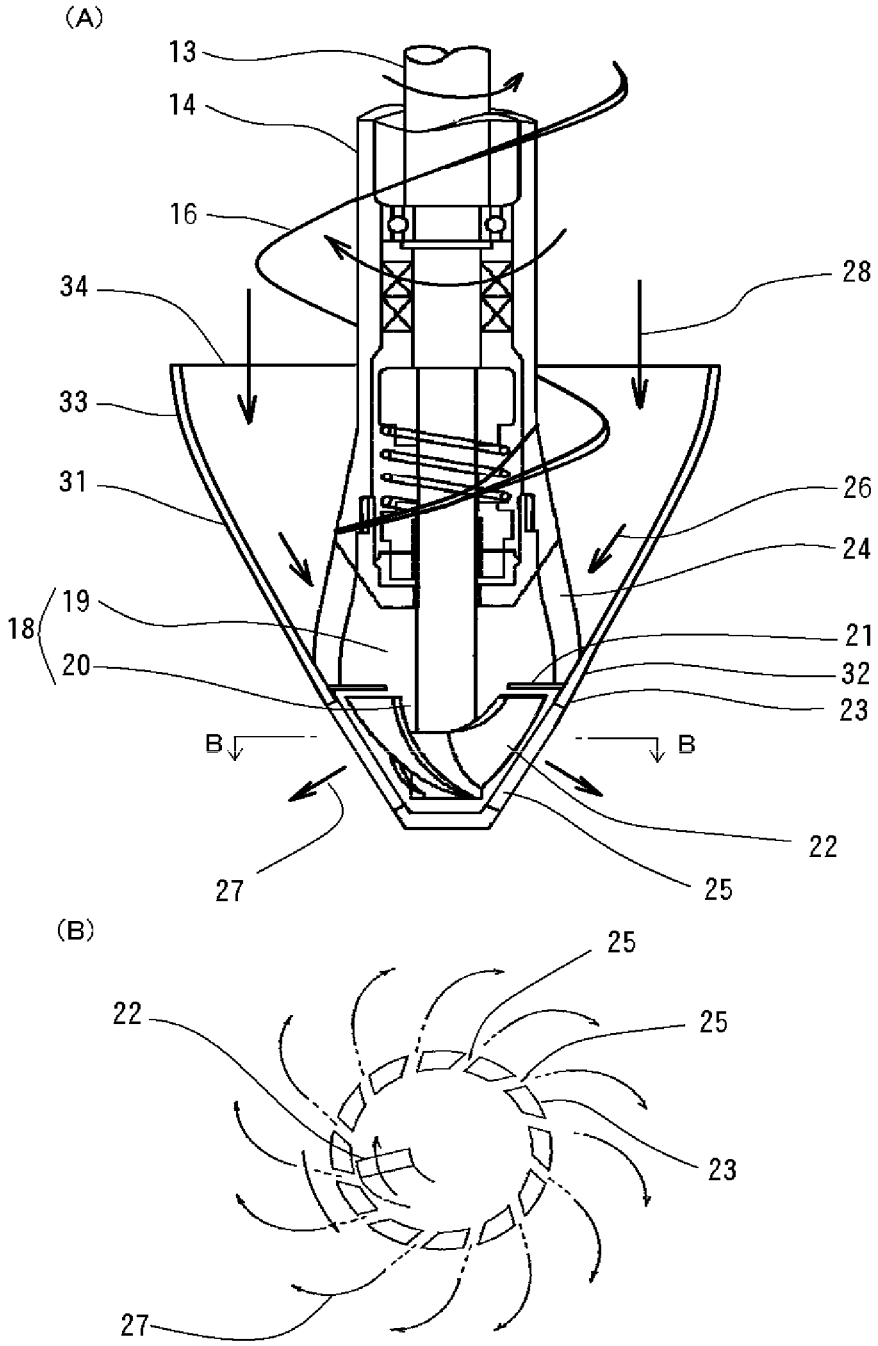
Figure 3:
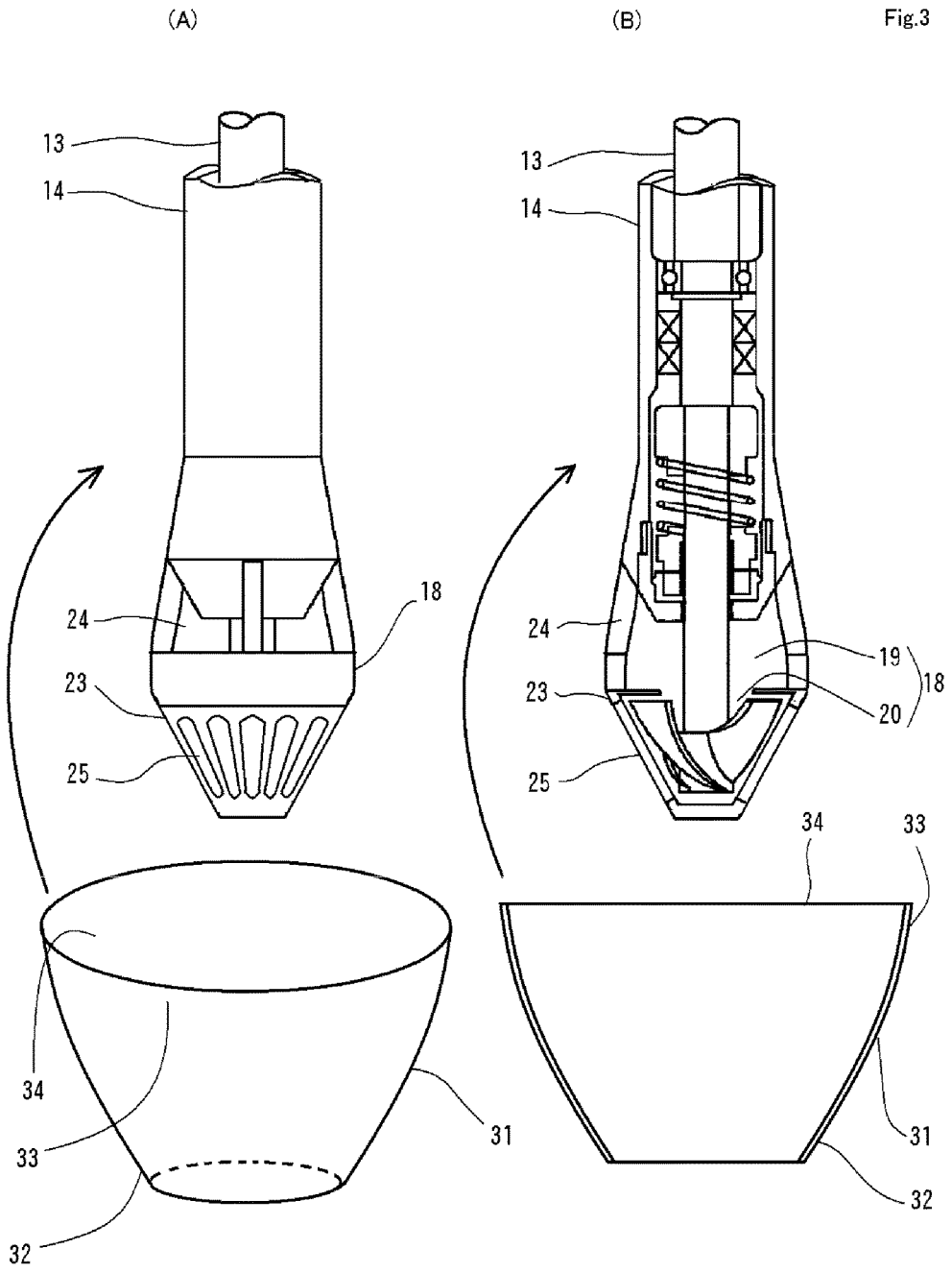

FIG. 1 to FIG. 3 relate to the first embodiment of the present invention, wherein the stirring-processing apparatus according to this embodiment has the stirring chamber 18 disposed in the processing vessel 11 in which the fluid to be processed is accommodated, so as to carry out the stirring process of the fluid. The processing vessel 11 has the covering cap 12 disposed detachably above an open top thereof. Meanwhile, hereunder, the terms such as upper, lower, left, and right suggest only relative positions so that these do not specify the absolute positions thereof.

In this embodiment, the stirring chamber 18 is provided with the suction room 19 in the upper part thereof and the shearing room 20 in the lower part thereof. Between the two is divided by the dividing wall 21, wherein there is an opening in the central part of the dividing wall 21 so that the fluid can go through sufficiently well between the suction room 19 and the shearing room 20. Meanwhile, the dividing wall 21 is not necessarily installed, so that the embodiment may also be executed without strictly dividing between the suction room 19 and the shearing room 20.

The suction room 19 is provided with at least one suction opening 24, and the shearing room 20 is provided with at least one ejecting opening 25. In this embodiment, the outer wall of the shearing room 20 is formed by the screen 23, and the slits arranged in the screen 23 work as the ejecting opening 25 mentioned above; however, a different wall member may be arranged outside the screen 23, and the ejecting opening 25 may be formed in this wall member.

The stirring chamber 18 is provided with, inside thereof, especially inside the shearing room 20 in this embodiment, the stirring blade 22 which rotates at a high speed so as to apply a shear force to the fluid in the space formed with the screen 23 which rotates in the opposite direction of the stirring blade 22 (see FIG. 2(B)). In this way, the rotation number of the relative rotation between the stirring blade 22 and the inner wall of the screen 23 can be increased; and therefore, even after the rotation number of the stirring blade 22 itself is increased to the limit to cause cavitation, the rotation number of the relative rotation between the stirring blade 22 and the inner wall of the screen 23 can be increased without causing cavitation by rotating the screen 23 toward the opposite direction thereof, so that the shear strength, the energy amount, and the passing number, namely the throughput, can be increased.

The rotation driving system will be explained herein. The stirring blade 22 rotates by means of the first axis 13; and the screen 23 rotates in the opposite direction thereof by means of the second axis 14. Both the first axis 13 and the second axis 14 are extended in the upward and downward directions. The second axis 14 is the axis having a hollow cylindrical form; and inside the second axis 14 is put through the first axis 13 rotatably. The first axis 13 and the second axis 14 rotate by a rotation driving source (not shown by the drawings) such as an electric motor installed above the covering cap 12. It is preferable that the rotation numbers of these two be controlled variably by an inverter or the like. This embodiment may be executed by arbitrarily changing these rotation numbers provided that the shearing process of the fluid would be within an acceptable range.

In the lower edge of the second axis 14, the stirring chamber 18 as mentioned above is installed, so that the suction room 19, the shearing room 20, and the screen 23 can rotate as a whole.

As shown in FIG. 1 and FIG. 2(A), this embodiment may be executed by arranging the introducing fin 16 to the second axis 14 in the part above the stirring chamber 18, although, as shown in FIG. 3, it may be executed without arranging the introducing fin 16 as well. The introducing fin 16 is formed spirally in the outer peripheral of the second axis 14; and this rotates together with the second axis 14 thereby generating the introducing flow 28 which sends the fluid in the upper part of the processing vessel 11 to the lower part thereof. Moreover, in this embodiment, the circulating fin 17 is arranged. The circulating fin 17 is arranged outside the introducing fin 16; and it rotates together with the second axis 14 and the introducing fin 16. The circulating fin 17 is extended spirally in the opposite direction of the introducing fin 16 thereby generating the circulating flow 29 which sends the fluid in the lower part of the processing vessel 11 to the upper part thereof. By these flows of the introducing flow 28 and the circulating flow 29, the fluid in the processing vessel 11 repeats the circulation upward and downward; and while repeating this movement, the shearing process by the stirring chamber 18 as mentioned above is executed.

During this shearing process, the stirring blade 22 rotates in the opposite direction of the screen 23; and as a result, the fluid is sucked from the suction opening 24 into the stirring chamber 18 (suction flow 26), and at the same time, the fluid is ejected from the ejecting opening 25 to outside the stirring chamber 18 (ejecting flow 27). Once the suction flow 26 entered from the suction opening 24 enters into the stirring chamber 19, and then, it is sucked into the shearing room 20 located below from the opening arranged in the central part of the dividing wall 21. In the shearing room 20, the shearing process is executed between the stirring blade 22 and the screen 23, and then, the fluid thus processed is ejected from the ejecting opening 25.

The effect mentioned above is the same in the apparatuses shown in the prior art literatures 1 to 3; and therefore, the present invention may be executed by similarly modifying the existing stirring-processing apparatuses of this kind including those shown in these prior art literatures.

The present invention is characterized by that the interference between the suction flow 26 and the ejecting flow 27 before and after the shearing process is suppressed in the above-mentioned apparatus.

Specifically, the suppressing body 31 is formed between the suction opening 24 arranged in the upper part and the ejecting opening 25 arranged in the lower part; these openings being disposed side by side in the direction of the rotation axis (hereunder, the term "direction in the rotation axis" used simply means the direction of the rotation axis of the first axis 13). The suppressing body 31 in this embodiment is a cylindrical form having the front end opening 34 in the upper part thereof, and the base end side 32 thereof is fixed to the outer wall of the stirring chamber 18 between the suction opening 24 and the ejecting opening 25. Moreover, the front end side 33 is projected toward outside the stirring chamber 18. More specifically, as going outward, it is getting away upward from the ejecting opening 25 located in the lower part in the direction of the rotation axis. Accordingly, the suppressing body 31 in this embodiment has an almost reverse truncated corn in which the diameter thereof becomes larger as going to the upper front end side 33. Especially in this embodiment, the front end side 33 of the suppressing body 31 is extended upward beyond the suction opening. On the other hand, the introducing fin 16 is extended spirally from up to down around the second axis 14, and the front end thereof (bottom end thereof) reaches near the suction opening 24. As a result, the bottom end side of the introducing fin 16 enters from the front opening 34 of the suppressing body 31 in the cylindrical form into inside the suppressing body 31. In other words, the edge (upper edge) of the front end side 33 of the suppressing body 31 is located above the edge of the front end side (lower end side) of the introducing fin 16 in the direction of the rotation axis. By so doing, the introducing flow 28 formed by the introducing fin 16 is introduced into the suppressing body 31 which has the cylindrical form, and sucked smoothly into the suction opening 24 without receiving the interference from the ejecting flow 27. Accordingly, even in the case of a highly viscous fluid, the fluid can be sucked from the suction opening 24 as the excellent suction flow 26, so that the shearing process as mentioned above can be continuously carried out without problems.

Meanwhile, in this embodiment, the suppressing body 31 rotates at a high speed together with the stirring chamber 18. By changing the form of the suppressing body 31 to a circular form in the cross section intersecting at the direction of the rotation axis, the rotation thereof hardly exerts an impact on the flow of the fluid; but the embodiment in which the form other than a circular form such as a polygonal form is employed is not excluded.

Figure 4:
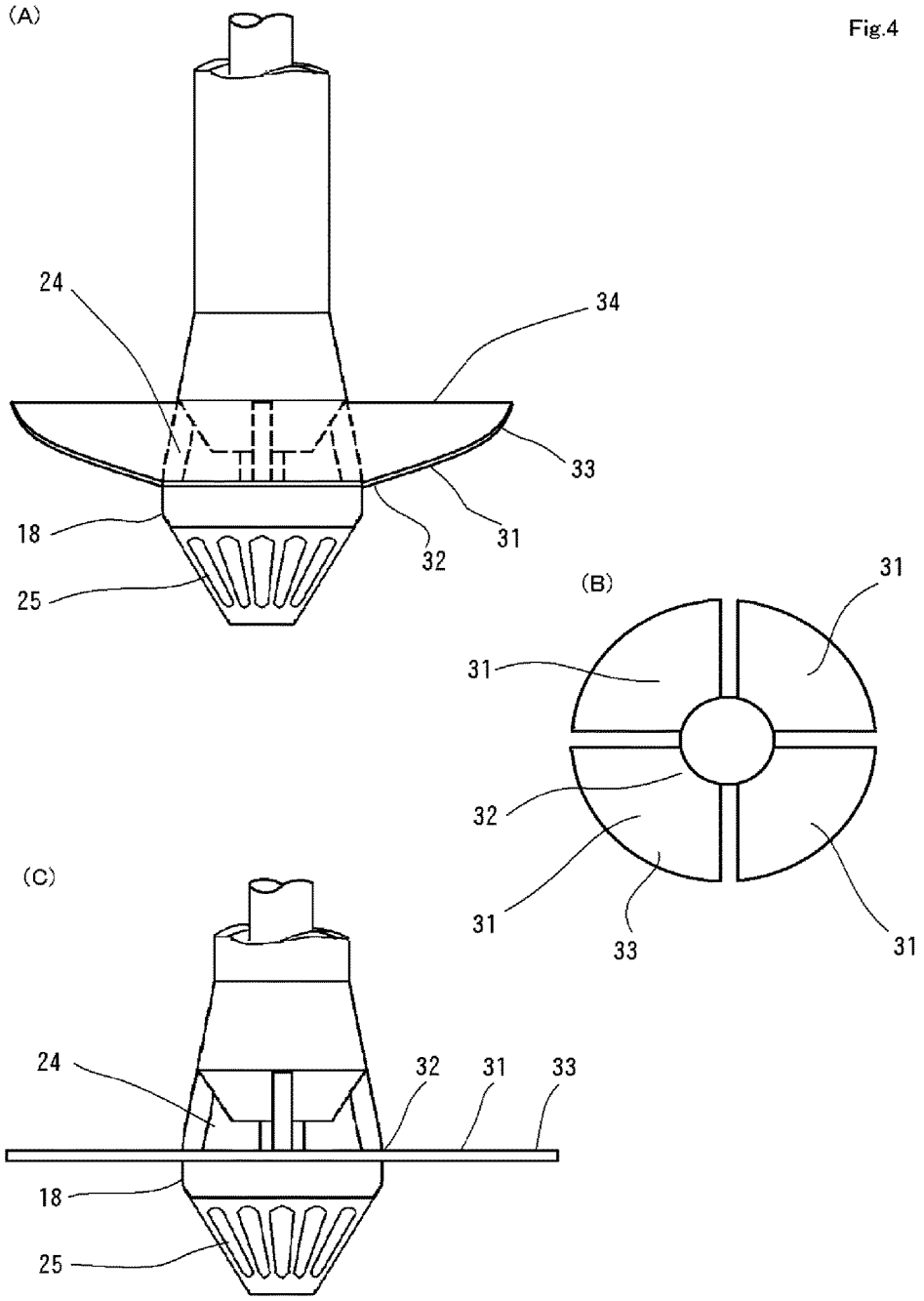

Next, by referring to FIG. 4, the modified example of the suppressing body 31 will be explained. Meanwhile, in the following explanation, too, the basic structure and action of the stirring-processing apparatus are the same as before; and thus, the explanation will be made by mainly focusing on the different part, so that, with regard to those points not explained hereunder, explanation of the foregoing embodiments shall be applied as it is.

In FIG. 4(A), the front end opening 34 of the suppressing body 31 is stopped when it reaches almost the same height as the upper end of the suction opening 24. Here, the suppressing body 31 guides the suction flow 26 into the suction opening 24 while avoiding the interference from the ejecting flow 27.

The suppressing body 31 of the present invention is preferably continuous in the circumferential direction; however, as shown in FIG. 4(B), it may be divided into plurality of the suppressing body 31 in the top view.

In addition, the suppressing body 31 of the present invention may be executed as the embodiment in which it is extended downward (direction to the ejecting opening 25) as going from the base end side 32 to the front end side 33 in the direction of the rotation axis; but it may be executed as a form of a flat plate not having a change in the direction of the rotation axis (see FIG. 4(C)).

Figure 5:
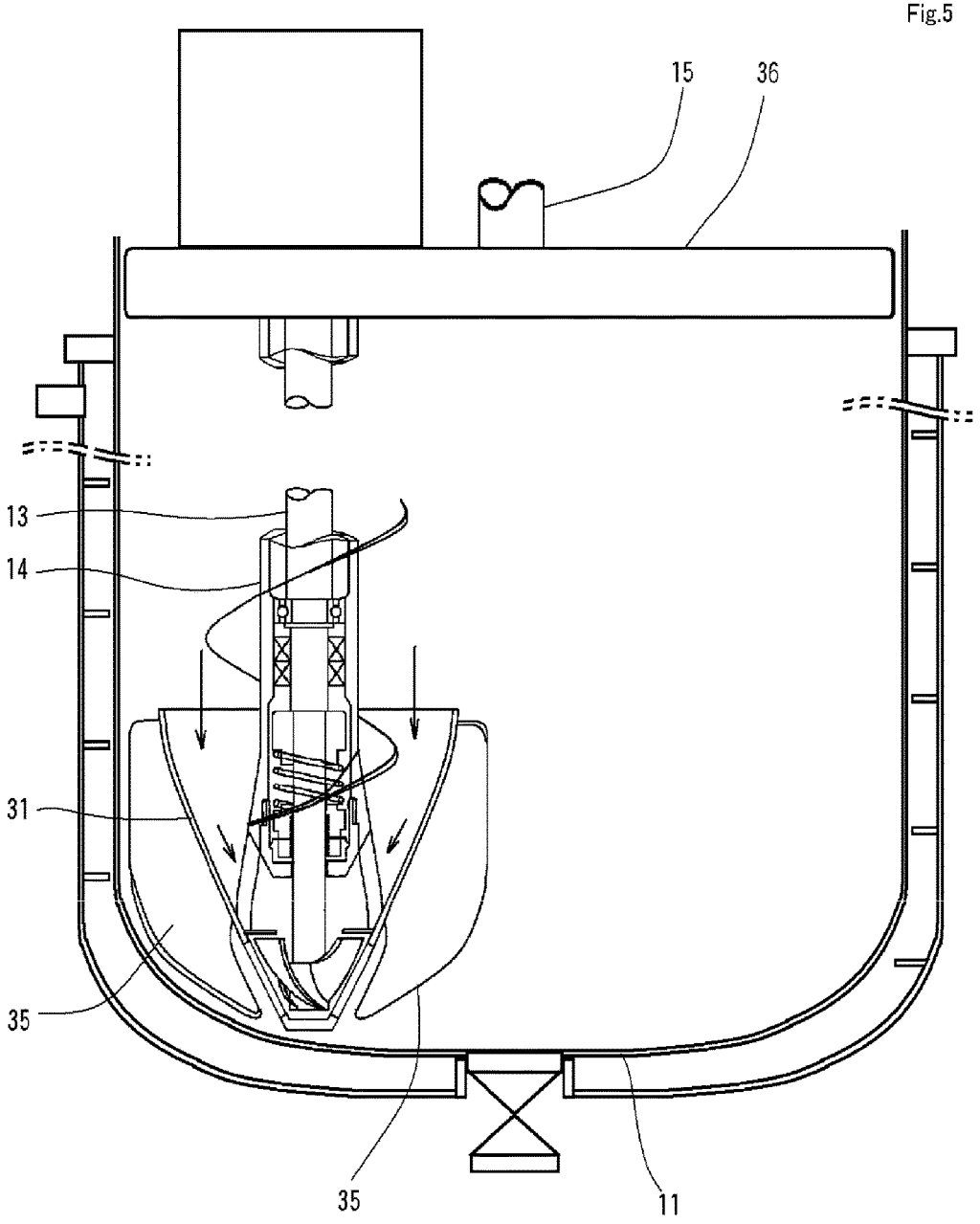

FIG. 5 shows still other embodiment; and in this embodiment, the auxiliary blade 35 is installed outside the suppressing body 31 which has the cylindrical form. By rotating together with the suppressing body 31, the auxiliary blade 35 carries out the action of stirring while transporting the fluid in the processing vessel 11 upward (especially near the bottom part). Although the embodiment maybe executed with one blade of the auxiliary blade 35, plurality of them are preferable.

In addition, in the above-mentioned embodiments, the stirring-processing apparatus is used while it is immersed in the fluid of the processing vessel 11, and therefore, the moving entity is not the whole of them; however, in the embodiment shown in FIG. 5, the stirring-processing apparatus moves in the processing vessel 11. Specifically, the first axis 13, the second axis 14, and the driving means thereof are attached to the rotating body 36 above the processing vessel 11, and the rotating body 36 is rotated by means of the third axis 15 so as to rotate around inside the processing vessel 11.

Figure 6:
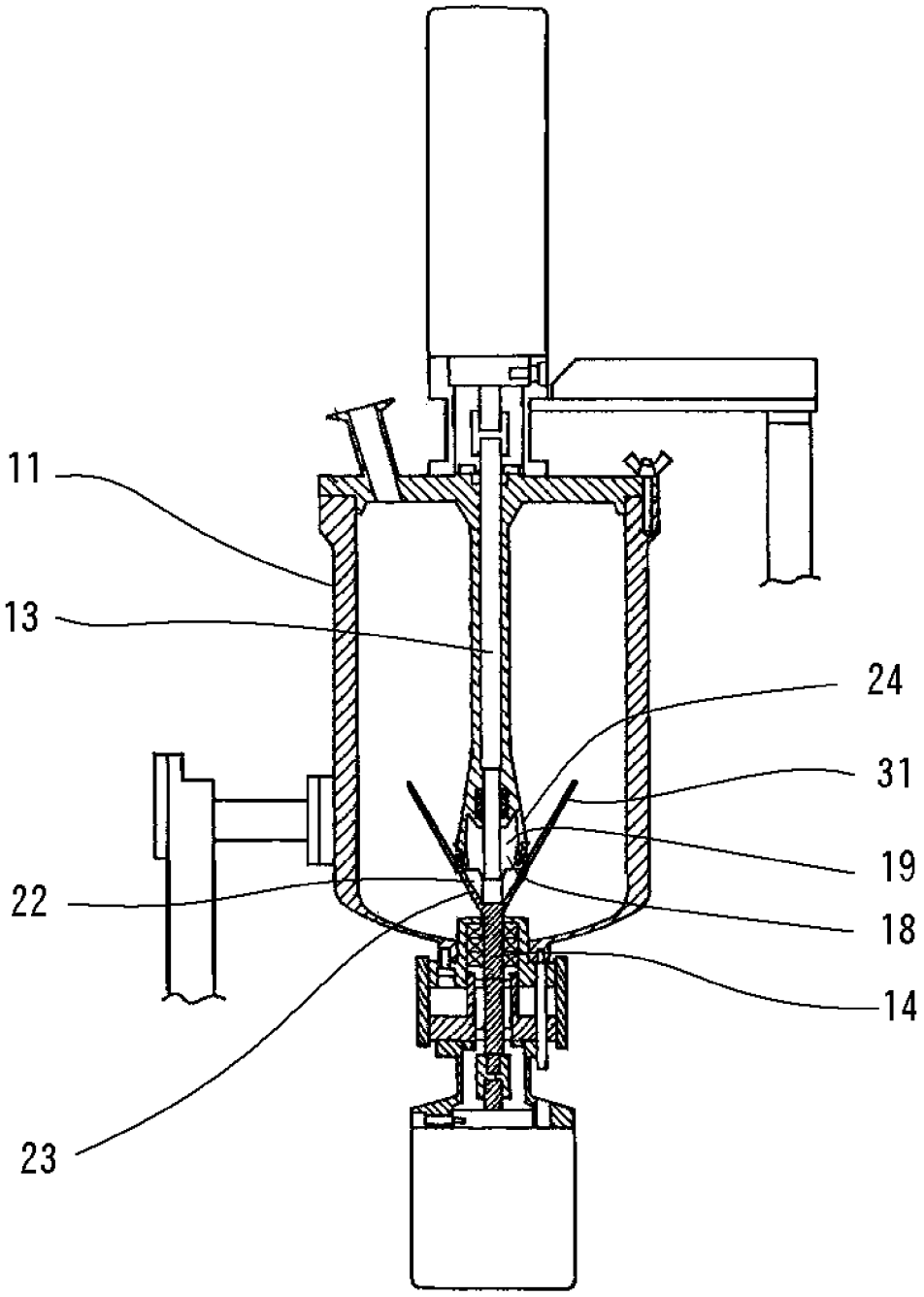

FIG. 6 shows still other embodiment, wherein the rotation driving means of the second axis 14 to rotate the screen 23 is installed in the bottom part of the processing vessel 11. In it, the second axis 14 is penetrated through upward from the bottom part, and the screen 23 is rotated while supporting it from thereunder. On the other hand, the first axis 13 to rotate the stirring blade 22 is extended upward in the processing vessel 11 similarly to the previous embodiments, wherein it is rotated by means of the rotation driving means installed in the up there. In so doing, the suction room 19 provided with the suction opening 24 is not rotated, and only the stirring blade 22 and the screen 23 rotate in the opposite directions with each other. Accordingly, if the suppressing body 31 is fixed on the side of the suction room 19, the embodiment can be executed without rotation thereof. If it is fixed on the side of the screen 23, the embodiment can be executed with rotation thereof.

As discussed above, the present invention may be executed as variously modified embodiments. In this embodiment, the angles of the suction opening 24 and the ejecting opening 25 are arranged at a slant such that the suction opening 24 maybe in the upward direction and the ejecting opening 25 in the downward direction, respectively, so that the suction flow 26 can be introduced diagonally downward from the up and the ejecting flow 27 can be ejected diagonally downward from the bottom of the suppressing body; however, embodiments having these angles changed variously may be executed. For example, the embodiment in which the both are arranged almost horizontally (in the direction almost orthogonal to the direction of the rotation axis) may also be possible. Even in the case like this, by arranging the suppressing body 31 between the suction opening 24 and the ejecting opening 25, the interference between the suction flow 26 and the ejecting flow 27 can be suppressed. In the above embodiments, the stirring chamber 18 is made to support the suppressing body 31; however, not only the second axis 14, but also the processing vessel 11 or the covering cap 12 may be made to support the suppressing body. In each of the above embodiments, the stirring blade 22 and the screen 23 are rotated in the opposite directions with each other; however, of these two, any one of them may be rotated. In other words, it is sufficient if the stirring blade 22 and the screen 23 are made to carry out the relative rotation so as to apply a shear force to the fluid.

Besides the fluids to be processed are such that the liquid which contains a synthetic resin such as toner particle and the like and a metal particle, in addition to this, the liquid not containing particles and two fluids comprising an oil and water; the present invention may be used for various fluids which require processing such as emulsification, dispersion, and mixing.

REFERENCE NUMERALS

11 Processing vessel
13 First axis
14 Second axis
15 Third axis
16 Introducing fin
17 Circulating fin
18 Stirring chamber
19 Suction room
20 Shearing room
22 Stirring blade
23 Screen
24 Suction opening
25 Ejecting opening
26 Suction flow
27 Ejecting flow
28 Introducing flow
29 Circulating flow
31 Suppressing body
32 Base end side
33 Front end side
35 Auxiliary blade

The invention claimed is:

1. A stirring-processing apparatus, comprising:

a stirring blade rotating at a high speed; and a stirring chamber provided with a screen which is disposed such that the stirring blade is enclosed therein, wherein the stirring-processing apparatus performs, under a state in which the stirring chamber is disposed in a fluid to be processed, a process of applying a shear force to the fluid by rotating at least any one of the screen and the stirring blade, thereby effecting a relative rotation between the screen and the stirring blade, wherein the stirring chamber includes:

a plurality of suction openings defined by a plurality of circumferentially spaced apart connecting parts each extending in a direction of a rotation axis of the relative rotation, to suck the fluid from outside to inside;

a plurality of ejecting openings formed on the screen to eject the fluid from inside to outside by the relative rotation, the plurality of suction openings and the plurality of ejecting openings being disposed in different positions in the direction of the rotation axis of the relative rotation; and an outer wall portion between the plurality of suction openings and the plurality of ejecting openings adjoining the plurality of circumferentially spaced apart connecting parts and the screen together, wherein a suppressing body is disposed on an outside of the outer wall portion and the plurality of circumferentially spaced apart connecting parts of the stirring chamber to control a flow of the fluid between the plurality of suction openings and the plurality of ejecting openings, the suppressing body comprising:

a base end positioned on the stirring chamber at a point thereof between the plurality of suction openings and the plurality of ejecting openings, the base end having a first outer diameter; and a front end extending from the base end radially outward and axially upward in the direction of the rotation axis of the relative rotation and away from the plurality of ejecting openings, the front end reaching or extending beyond upper ends of the plurality of circumferentially spaced apart connecting parts, and having a second outer diameter larger than the first outer diameter of the base end, the front end being radially spaced apart from the plurality of circumferential spaced apart connecting parts, and wherein the suppressing body is interposed between a suction flow, which is a flow of the fluid from the outside into the plurality of suction openings, and an ejecting flow, which is a flow of the fluid ejected from the plurality of ejecting openings to the outside, thereby suppressing an interference between the suction flow and the ejecting flow as well as preventing disturbing the flow of the suction flow into the plurality of suction openings due to the ejecting flow.

2. The stirring-processing apparatus according to claim 1, wherein the suppressing body has a front end side thereof projected toward the outside of the stirring chamber.

3. The stirring-processing apparatus according to claim 2, wherein the suppressing body is continuous in a circumferential direction.

4. The stirring-processing apparatus according to claim 2, wherein an introducing fin is arranged to introduce the fluid by rotation thereof, and wherein an edge of the front end of the suppressing body is located in a position more apart from the plurality of suction openings than an edge of the introducing fin located in the nearest position to the plurality of suction openings in the direction of the rotation axis of the relative rotation.

5. The stirring-processing apparatus according to claim 1, wherein the suppressing body is continuous in a circumferential direction.

6. The stirring-processing apparatus according to claim 5, wherein an introducing fin is arranged to introduce the fluid by rotation thereof, and wherein an edge of the front end of the suppressing body is located in a position more apart from the plurality of suction openings than an edge of the introducing fin located in the nearest position to the plurality of suction openings in the direction of the rotation axis of the relative rotation.

7. The stirring-processing apparatus according to claim 1, wherein the suppressing body has a cylindrical form.

8. The stirring-processing apparatus according to claim 7, wherein an introducing fin is arranged to introduce the fluid by rotation thereof, and wherein an edge of the front end of the suppressing body is located in a position more apart from the plurality of suction openings than an edge of the introducing fin located in the nearest position to the plurality of suction openings in the direction of the rotation axis of the relative rotation.

9. The stirring-processing apparatus according to claim 1, wherein an introducing fin is arranged to introduce the fluid by rotation thereof, and wherein an edge of the front end of the suppressing body is located in a position more apart from the plurality of suction openings than an edge of the introducing fin located in the nearest position to the plurality of suction openings in the direction of the rotation axis of the relative rotation.

10. The stirring-processing apparatus according to claim 1, further comprising an electric motor configured to drive the stirring blade to rotate via a first driving axis, and to drive the screen to rotate via a second drive axis, the first drive axis being positioned within the second drive axis, and being coaxial with the second drive axis, wherein the screen rotates in an opposite direction from a rotating direction of the stirring blade.

11. The stirring-processing apparatus according to claim 1, further comprising an electric motor configured to drive the screen to rotate via a drive axis, wherein the screen is rotatable with respect to the suppressing body.

12. The stirring-processing apparatus according to claim 1, wherein the second outer diameter of the front end is larger than an outer diameter of the outer wall portion of the stirring chamber.

13. The stirring-processing apparatus according to claim 1, further comprising an electric motor configured to drive the stirring blade to rotate via a first driving axis, and to drive the screen to rotate via a second drive axis, the first drive axis being positioned within the second drive axis, and being coaxial with the second drive axis, wherein:

the screen forms a part of an outer wall of the stirring chamber, the base end of the suppressing body is fixed to the outer wall of the stirring chamber at a position between the plurality of suction openings and the plurality of ejecting openings, the stirring-processing apparatus further comprises an auxiliary blade installed outside the suppressing body, the screen and the stirring blade rotate in opposite direction each other, thereby effecting a relative rotation between the screen and the stirring blade, and the suppressing body rotates together with the screen, and the auxiliary blade rotates together with the suppressing body.

14. A stirring-processing method, comprising the steps of:

stirring a fluid by using a stirring apparatus provided with a stirring chamber and a stirring blade disposed in the stirring chamber, the stirring chamber being provided with a screen, at least any one of the screen and the stirring blade being rotated thereby effecting a relative rotation between the screen and the stirring chamber, the stirring chamber including:

a plurality of suction openings defined by a plurality of circumferentially spaced apart connecting parts each extending in a direction of a rotation axis of the relative rotation, to suck the fluid from outside to inside, a plurality of ejecting openings formed on the screen to eject the fluid from inside to outside by the relative rotation, the plurality of suction openings and the plurality of ejecting openings being disposed in different positions in the direction of the rotation axis of the relative rotation; and an outer wall portion between the plurality of suction openings and the plurality of ejecting openings adjoining the plurality of circumferentially spaced apart connecting parts and the screen together;

disposing the stirring chamber in the fluid;

transporting the fluid by the relative rotation, whereby sucking the fluid from outside the stirring chamber into an inside thereof while ejecting the fluid from the plurality of ejecting openings to outside;

applying a shear force to the fluid in between the stirring blade and the screen by the relative rotation during the step of transporting; and disposing a suppressing body on an outside of the outer wall portion and the plurality of circumferentially spaced apart connecting parts of the stirring chamber to control a flow of the fluid between a suction flow, which is a flow of the fluid from outside into the plurality of suction openings, and an ejecting flow, which is a flow of the fluid ejected from the plurality of ejecting openings to the outside, thereby suppressing an interference between the suction flow and the ejecting flow as well as preventing disturbing the flow of the suction flow into the plurality of suction openings due to the ejecting flow, wherein the suppressing body comprises:

a base end positioned on the stirring chamber between the plurality of suction openings and the plurality of ejecting openings, the base end having a first outer diameter; and a front end extending from the base end radially outward and axially upward in the direction of the rotation axis of the relative rotation and away from the plurality of ejecting openings, the front end reaching or extending beyond upper ends of the plurality of circumferentially spaced apart connecting parts, and having a second outer diameter larger than the first outer diameter of the base end, the front end being radially spaced apart from the plurality of circumferential spaced apart connecting parts.

15. The stirring-processing method according to claim 14, wherein the stirring apparatus is provided with an introducing fin to introduce the fluid by rotation thereof; and an introducing flow of the fluid generated by rotation of the introducing fin is guided to the plurality of suction openings by the suppressing body.

* * * * *